US005115119A

United States Patent [19]

Adachi et al.

[11] Patent Number: 5,115,119

[45] Date of Patent: May 19, 1992

[54] HEATING APPARATUS AND HEATER

[75] Inventors: Nobukazu Adachi; Toshio Yoshimoto, both of Tokyo, Japan

[73] Assignee: Canon Kabushiki Kaisha, Tokyo, Japan

[21] Appl. No.: 541,387

[22] Filed: Jun. 21, 1990

[30] Foreign Application Priority Data

Jun. 23, 1989 [JP] Japan ..... 1-161302

[51] Int. Cl.[5] ..... G03G 15/20

[52] U.S. Cl. ..... 219/469; 219/216

[58] Field of Search ..... 219/216, 469–471; 355/290; 392/408, 416, 418, 419, 424

[56] References Cited

U.S. PATENT DOCUMENTS

| | | | |
|---|---|---|---|
| 3,333,088 | 7/1967 | Verbeek | 219/471 |
| 3,409,280 | 11/1968 | Springett | 219/469 |
| 3,437,032 | 4/1969 | Manghirmalani et al. | 100/93 |
| 3,946,353 | 3/1976 | Gallagher | 392/424 |
| 3,973,844 | 8/1976 | McCarroll | 219/469 |
| 4,541,708 | 9/1985 | Shigenobu . | |

OTHER PUBLICATIONS

Patent Abstracts of Japan, vol. 12, No. 339, Sep. 12, 1988, JP 63-98684, Apr. 30, 1988.

Patent Abstracts of Japan, vol. 14, No. 240, May 22, 1990, JP 2-62571, Mar. 2, 1990.

*Primary Examiner*—Teresa J. Walberg

*Attorney, Agent, or Firm*—Fitzpatrick, Cella, Harper & Scinto

[57] ABSTRACT

A heating apparatus includes a heat rotary member, a heater arranged in the heat rotary member along a rotation center line thereof and having a low heat-conductive base member at each end, and a holder member for holding at least one of the base members. One base member has an outer configuration larger than that of the other base member. In addition, the heater can be removed from the heat rotary member along the rotation center line without removing the holder member.

21 Claims, 4 Drawing Sheets

HEATING APPARATUS AND HEATER

BACKGROUND OF THE INVENTION

1. Field of the Invention

The present invention relates to a heating apparatus adapted to be used with an image forming system such as an optical printer, copying machine or the like, and more particularly, it relates to a heating apparatus effectively used as a heating and fixing unit for the image forming system, and a heater used in the heating apparatus.

2. Related Background Art

Conventionally, heat roller fixing systems using a heat roller having a heater such as a halogen lamp therein have widely been used as a fixing unit for fixing a toner image onto a recording medium.

FIG. 9 shows a sectional view of a conventional heat roller fixing unit.

In FIG. 9, a heat roller 1 has a halogen lamp 28 therein. The reference numeral 2 denotes a pressure roller; 3 and 6 denote bearings; 4 denotes a drive gear for the heat roller; 5 denotes a ring for preventing the bearing 3 and the gear 4 from sliding off from the roller 1 in the thrust direction; 7 denotes a spring for biasing pressure roller 2 against the heat roller 1; 12 denotes a lead wire for supplying an electric power to the halogen heater; 13 denotes a conductive plate acting as an contact between the lead wire 12 and a power source; 14 denotes leaf springs for positioning the halogen lamp; 15 denotes an electrode of the power source side; 20 denotes an earth spring for earthing the heat roller 1; and 25 denotes insulating and low heat-conductive base portions made of ceramic and arranged on both sides of the halogen lamp.

Incidentally, the reference numerals 13*a* and 14*a* denote biases or screws.

In this way, the halogen lamp 28 is positioned and fixed by supporting the ceramic bases 25 of both sides of the lamp by means of the leaf springs 14 fixedly mounted on a fixed portion by the screws 14*a*.

However, in the above conventional example, since the halogen lamp 28 with the lead wires 12 must be inserted into the interior of the fixing roller 1 from one side thereof and the lead wire 12 must be drawn out of the interior of the roller from the other side thereof, the operability of the assembling is decreased and, in order to replace the halogen lamp 28, many parts including the leaf springs 14 must be disassembled.

Further, since the earth ring 20 electrically connected to the fixing roller 1 is mounted on the end of the fixing roller, the operability is further decreased. In addition, since the inner diameter of the fixing roller 1 cannot be reduced to keep the easy insertion of the lead wires 12 into the fixing roller, the fixing roller and accordingly the whole apparatus cannot be made small-sized.

SUMMARY OF THE INVENTION

An object of the present invention is to provide a fixing unit which permits the easy replacement of a heater.

Another object of the present invention is to provide a heating apparatus wherein a heater can easily be mounted on and dismounted from the apparatus without dismounting a holding plate for holding a heater.

A further object of the present invention is to provide a heating apparatus wherein a heater having a larger base portion and a smaller base portion is used and the heated is inserted from its smaller base portion.

Other objects of the present invention will be apparent from the following description.

DESCRIPTION OF THE PREFERRED EMBODIMENTS

Figure 1:
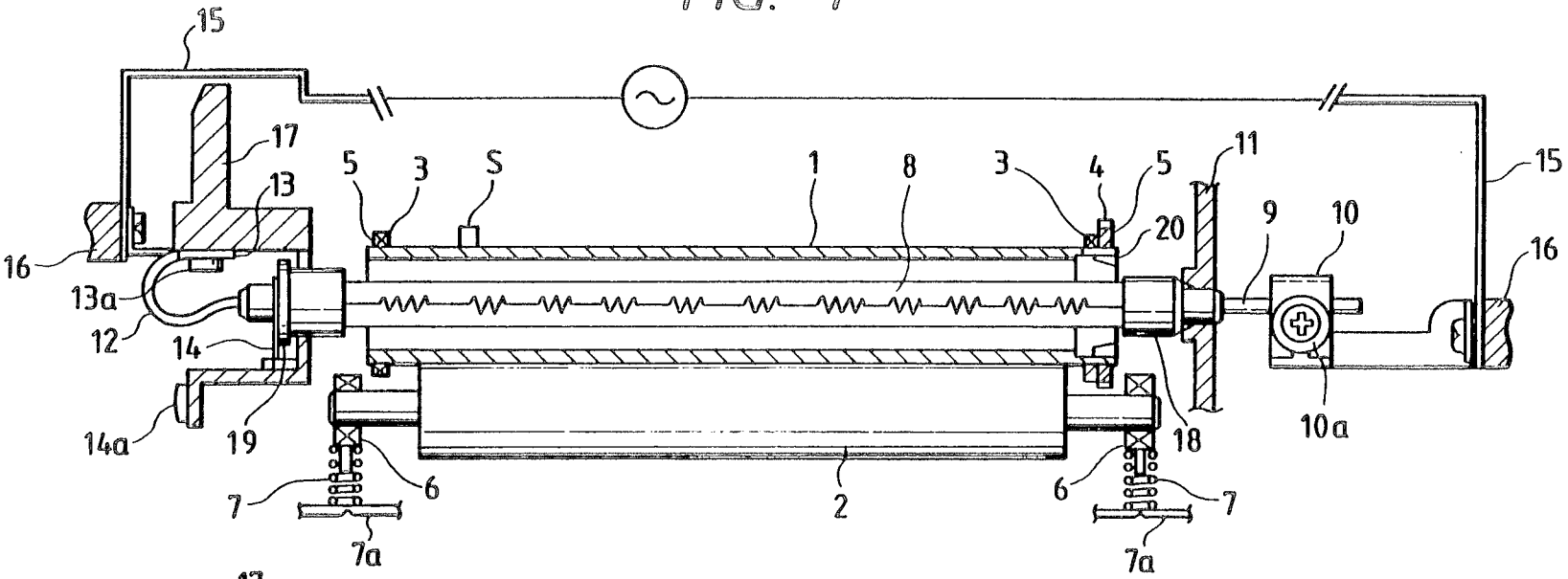
FIG. 1 is a sectional view of a fixing system according to a preferred embodiment of the present invention.

The present invention will now be explained in connection with embodiments thereof with reference to the accompanying drawings. Incidentally, elements having the same function are designated by the same reference numerals.

In FIG. 1, a heat roller 1 has a halogen lamp 8 therein and is made of a metallic cylinder coated by a surface lublicant layer. A thermistor S is provided for detecting temperature of a surface of the heat roller 1, and the energization of the halogen lamp 8 is ON/OFF controlled on the basis of a detected output from the thermistor. In this way, the surface temperature of the heat roller 1 can be maintained at a constant value.

A back-up roller 2 having a silicone rubber layer is pressed against the heat roller 1. A recording medium with a surface having a non-fixed toner image thereon (which surface faces toward the heat roller 1) is pinched between the rollers 1 and 2 and is fed by them; meanwhile, the toner image is fixed on the recording medium by the heat and pressure.

An electrode terminal 9 projects from one end of the halogen lamp 8 in a longitudinal direction thereof and is made of deformable nickel-plated copper wire. The reference numeral 10 denotes contact plates tightened by a screw 10*a* with the interposition of the electrode terminal 9, thereby electrically connecting therebetween.

The reference numeral 11 denotes a halogen lamp retainer for positioning and holding the halogen lamp 8 by fitting a base 18 of the lamp thereto; 16 denotes an insulation support for supporting connecting portions between the power source and the contact plates 10 or a conductive plate 13; 17 denotes a holder for supporting the halogen lamp 8 with an aid of a leaf spring 14; 18 denotes the base of the halogen lamp at an insertion side; 19 denotes a base of the halogen lamp 8 at a side opposite to the insertion side; and 20 denotes a conductive ring electrically connected to the fixing roller 1 and provided for earthing the fixing roller through a leaf spring (not shown) slidingly contacting with the conductive ring.

Figure 2:
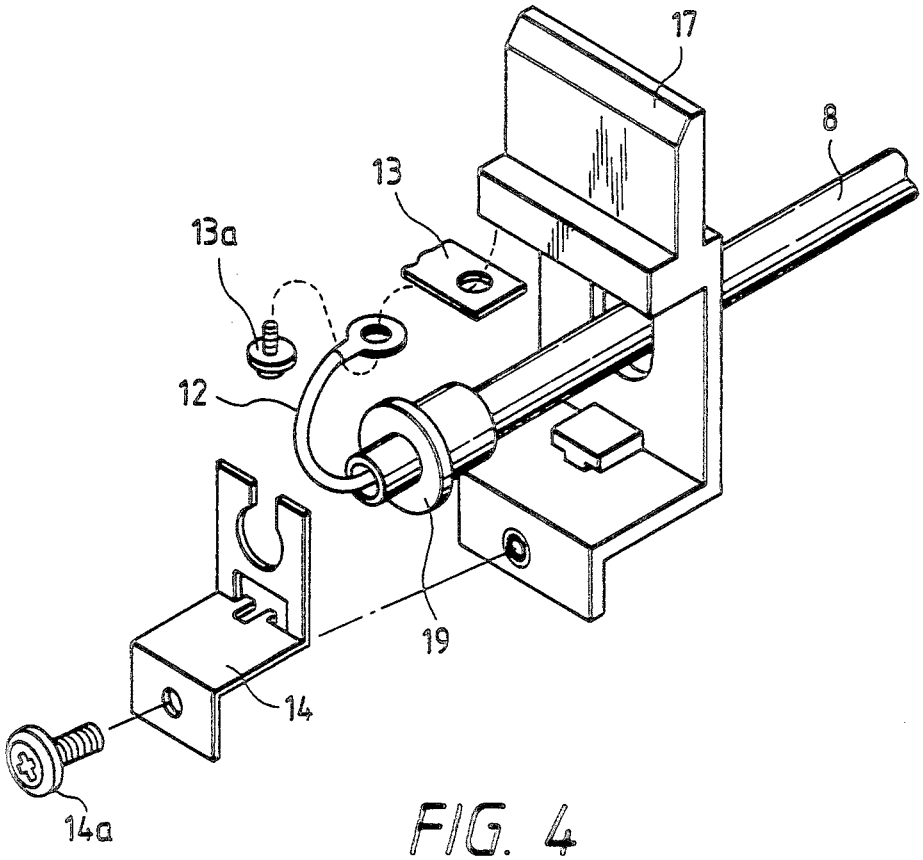
FIG. 2 is an exploded perspective view showing the assembling of a base portion and a holder at a side opposite to an insertion side.
Figure 4:
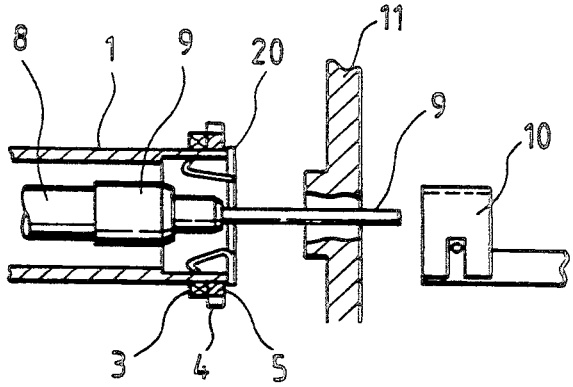
FIG. 4 is a sectional view showing the assembling of the base portion at the insertion side.

As shown in FIG. 2, the halogen lamp 8 is assembled in a condition that the base 19 thereof is pinched between the holder 17 and the leaf spring 14. In this case, a flange of the base 19 has a larger diameter than those of an opening (through which the halogen lamp is inserted) of the holder 17 and an opening of the leaf spring 14, and also larger than the diameters of the other base 18 and of a glass tube of the halogen lamp 8. The glass tube constituting a heat dispersing area of the lamp.

Figure 3:
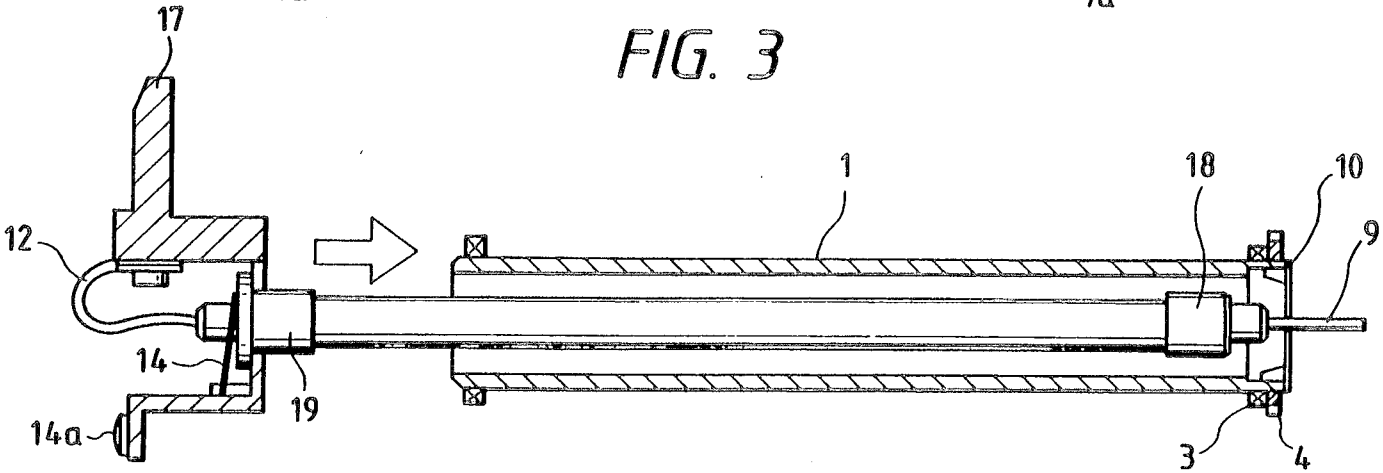
FIG. 3 is a sectional view showing a condition that the assembled halogen lamp and holder is being inserted into a fixing roller.

Accordingly, as shown in FIG. 3, after the halogen lamp 8 is assembled to the holder 17, the halogen lamp is inserted into the fixing roller 1 with the holder 17.

Here, the larger diameter means that the cross-section thereof completely includes therein the cross-section of the smaller diameter.

In this way, in case of the replacement of the halogen lamp, it is possible to remove or dismount the halogen lamp 8 from the fixing roller 1 without dismounting the holder 17.

Further, in the conventional fixing unit, if the conductive ring 20 is mounted on the fixing roller at the side opposite to the insertion side, the conductive ring also obstructed the passage of the base of the halogen lamp. To the contrary, according to this embodiment of the invention, since the base 18 at the insertion side has the smaller diameter than that of the other base 19 and has a tapered tip, the base 18 can smoothly be inserted into the retainer 11 (FIG. 1) without being obstructed by the conductive ring 20.

In this way, in accordance with this embodiment, the insertion of the heater to the fixing roller and the replacement of the heater are very easy. Further, since the lead wire 12 is connected to the conductive plate 13 of the holder 17 as well as the halogen lamp 8 is assembled to the holder 17, when the halogen lamp 8 with the holder 17 is assembled to the fixing roller 1, the conductive plate 13 can merely be connected to the conductive portion from the power source at the insulation support 16. Thus, it is not needed to assemble by grasping the lead wire directly.

In addition, when the halogen lamp 8 is inserted into the fixing roller 1 by grasping the holder, the lamp can be inserted into the roller. Accordingly, since the halogen lamp is not contacted by the operator's hand, the lamp is not smeared by oil and the like. Furthermore, since the electrode terminal 9 at the insertion side has the rod-shaped configuration, the base 18 can be easily received in the retainer 11.

Figure 5:
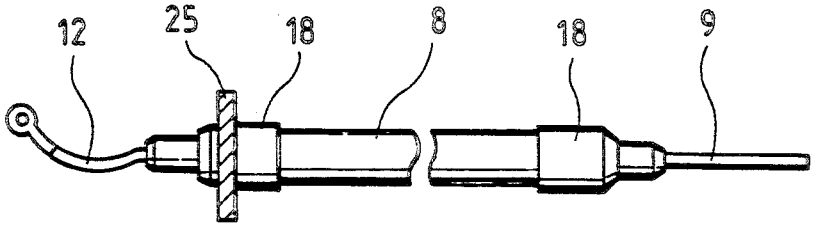
FIGS. 5 to 8 show heaters according to other embodiments.

As shown in FIG. 5, the configuration of the base at the side opposite to the insertion side may have the same configuration as the base at the insertion side and may include a larger ring 25. However, in consideration of the insertion and removal of the halogen lamp having bases of the same configuration with respect to the holder 17, it is preferable that one of the base is larger than the other.

Figure 6:
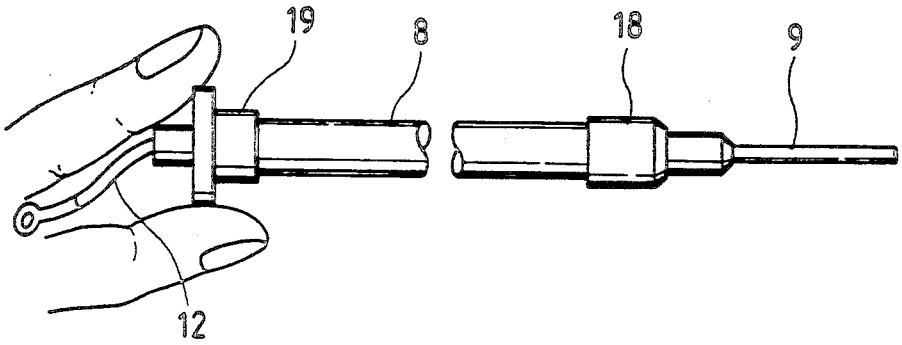

In the illustrated embodiment, while an example that the halogen lamp is assembled to the holder and the lamp with the holder is inserted into the fixing roller was explained, only the halogen lamp may be assembled to the fixing roller by grasping it by hand, as shown in FIG. 6. Also, in this case, the base at the side opposite to the insertion side may be larger than the other base to facilitate the grasping of the base.

Figure 7:
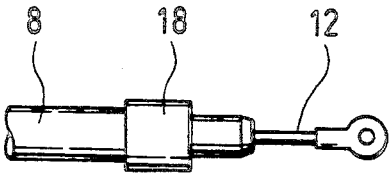

While the base 18 at the insertion side had the tapered tip, if the base is adequately smaller, such tapered tip may be omitted. The electrode terminal 9 projecting from the base 18 at the insertion side was provided, a lead wire 12 may be provided in place of the electrode terminal, as shown in FIG. 7.

Figure 8:
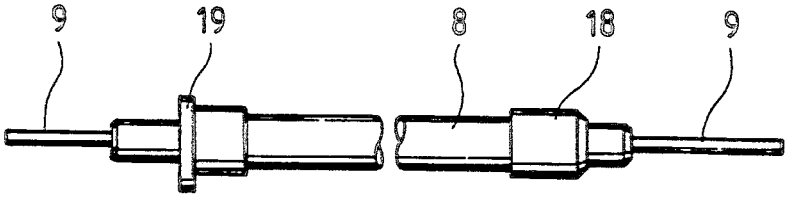
Figure 9:
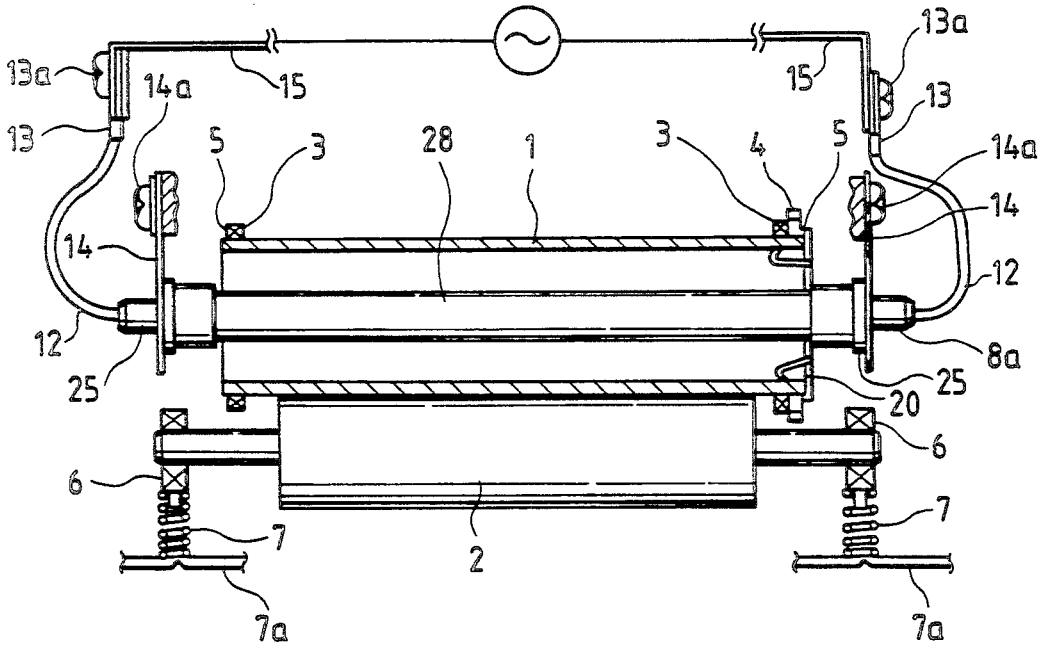
FIG. 9 is a sectional view of a conventional fixing unit.

Further, while the lead wire 12 extending from the base 19 at the side opposite to the insertion side was provided, an electrode terminal 9 may be provided in place of the lead wire, as shown in FIG. 8.

As mentioned above, according to the present invention, the assembling and the replacement of the heater becomes very easy, and, if the invention is applied to the heat roller fixing unit, it is possible to reduce the diameter of the heat roller. Although the above description has been made with particular reference to embodiments, it will be understood that variations and modifications can be effected within the spirit and scope of the present invention.

What is claimed is:

1. A heating apparatus comprising:

a heat rotary member;

a heater arranged in said heat rotary member along a rotation center line thereof, said heater having first and second base members at first and second ends thereof, respectively, with a lead wire for supplying power connected to said first base member and an electrode pin for supplying power connected to said second base member;

a holder member for holding said first base member, wherein said heater can be removed from said heat rotary member by pulling said first base member with said lead wire in an axial direction without removing said holder member.

2. A heating apparatus according to claim 1, wherein said first base member held by said holder member has a larger base portion than said second base member.

3. A heating apparatus according to claim 1, wherein said electrode pin projects along the rotation center line of rotary member.

4. A heating apparatus according to claim 1, wherein said first and second base members are made of an insulation material.

5. A heating apparatus according to claim 1, wherein said heat rotary member comprises a heat roller capable of melting a toner image, and said heating apparatus fixes the toner image on a recording medium.

6. A heating apparatus according to claim 5, wherein said apparatus further includes a back-up roller pressed against said heat roller, wherein said heat and back-up rollers pinch and feed the recording medium therebetween and fix the toner image on the recording medium.

7. A heating apparatus according to claim 1, wherein said second base member is has a tapered tip adjacent to said electrode pin.

8. A heating apparatus according to claim 1, wherein said first and second base members are made of a low temperature conductive material.

9. A heating apparatus according to claim 1, wherein said second base member has a tapered tip end adjacent to said electrode pin.

10. A heater comprising:

a heating device having first and second ends and a heat dispersing area;

first and second low heat-conductive base members arranged on said first and second ends, respectively, with an outer periphery of said first base member being larger than an outer periphery of said second base member and an outer periphery of said heating device a lead wire connected to said first base member for supplying power; and an electrode pin provided on said second base member for supplying power.

11. A heater according to claim 10, further comprising a holder member for holding said first base member.

12. A heating apparatus according to claim 10, wherein said electrode pin projects along a longitudinal direction of said heater.

13. A heater according to claim 12, wherein said second base member has a tapered tip adjacent said electrode pin.

14. A heater according to claim 10, wherein said first and second base members are made of an insulation material.

15. A heating apparatus, comprising:

a heat rotary member; and a heater arranged in said heat rotary member along a rotation center line thereof, said heater having first and second heat insulating base members at first and second ends, respectively, with a lead wire for supplying power connected to said first base member and an electrode pin for supplying power connected to said second base member, wherein said first base member has an outer periphery larger than that of said second base member such that said heater is capable of being easily removed from said heat rotary member.

16. A heating apparatus according to claim 15, wherein said electrode pin projects along the rotational center of said heat rotary member.

17. A heating apparatus according to claim 15, wherein said first and second base members are made of an insulation material.

18. A heating apparatus according to claim 15, wherein said heat rotary member comprises a heat roller capable of melting a toner image, and said heating apparatus fixes the toner image on a recording medium.

19. A heating apparatus according to claim 18, further comprising a back-up roller pressed against said heat roller, wherein said heat roller and said back-up roller pinch and feed the recording medium therebetween and fix the toner image on the recording medium.

20. A heating apparatus according to claim 15, further comprising a holder for releasably holding said heater.

21. A heating apparatus according to claim 20, wherein said holder has an opening through which said heater is inserted, and an outer configuration of the opening is smaller than the outer periphery of said first base member.

* * * * *

UNITED STATES PATENT AND TRADEMARK OFFICE

CERTIFICATE OF CORRECTION

PATENT NO. : 5,115,119

DATED : May 19, 1992

INVENTOR(S) : Nobukazu Adachi, et al.

It is certified that error appears in the above-identified patent and that said Letters Patent is hereby corrected as shown below:

COLUMN 1:

Line 28, "an" should read --a--.

COLUMN 2:

Line 2, "heated" should read --heater--.

COLUMN 4:

Line 48, "is" should be deleted.
Line 64, "device" should read --device;--.

COLUMN 5:

Line 3, "heating apparatus" should read --heater--.

Signed and Sealed this

Thirty-first Day of August, 1993

Bruce Lehman

*Attest:*

BRUCE LEHMAN

*Attesting Officer*

*Commissioner of Patents and Trademarks*